US006763841B1

(12) United States Patent
Cantwell

(10) Patent No.: US 6,763,841 B1
(45) Date of Patent: Jul. 20, 2004

(54) TENT WITH EXTENDABLE WINDOWS

(75) Inventor: Robert R. Cantwell, Leslie, MO (US)

(73) Assignee: NorthPole Limited (HK)

( * ) Notice: Subject to any disclaimer, the term of this patent is extended or adjusted under 35 U.S.C. 154(b) by 0 days.

(21) Appl. No.: 10/086,514

(22) Filed: Feb. 28, 2002

Related U.S. Application Data

(60) Provisional application No. 60/272,385, filed on Feb. 28, 2001.

(51) Int. Cl.[7] ..... E04H 15/58

(52) U.S. Cl. ..... 135/117; 135/93

(58) Field of Search ..... 135/117, 115, 135/119, 93, 125, 120.1, 120.2, 88.1, 88.12, 91, 94, 95, 97, 900

(56) References Cited

U.S. PATENT DOCUMENTS 1,833,096 A * 11/1931 Smith ..... 135/91
2,230,454 A * 2/1941 Friesner et al. ..... 135/117
3,800,814 A * 4/1974 Hibbert ..... 135/93
4,265,261 A * 5/1981 Barker ..... 135/100
5,467,794 A * 11/1995 Zheng ..... 135/125
6,067,676 A * 5/2000 Carnahan et al. ..... 5/99.1
6,499,497 B1 * 12/2002 Swetish et al. ..... 135/115

FOREIGN PATENT DOCUMENTS

FR 1268271 * 6/1961 ..... 135/117

OTHER PUBLICATIONS

American Camper brochure; Dome tents No. 4679 and No. 4681; 1996.*

* cited by examiner

*Primary Examiner*—Janet M. Wilkens
(74) *Attorney, Agent, or Firm*—IPSG, P.C.

(57) ABSTRACT

A tent (10) with tendable windows (14) having a main structure (12) including a plurality of walls (16,18,20) which are oriented at a first angle (60) with respect to a vertical reference. The tent (10) also includes at least one window (14) which is extendable to a second angle (62) with respect to a vertical reference, where the second angle (62) is a more negative angle than the first angle (60) thus producing windows (14) which are horizontally extendable further than the tent walls (16,18,20).

10 Claims, 4 Drawing Sheets

TENT WITH EXTENDABLE WINDOWS

This application claims priority from U.S. Provisional Applications Serial No. 60/272,385 filed Feb. 28, 2001, which has the same inventor as the present application.

FIELD

The present invention relates generally to portable living structures and specifically to tents.

ART

Tents have been used for centuries as temporary structures for camping trips. During these trips, there may be competing desires for comfort on one band, while a camper may still desire to get away from the complications of city life. The use of lightweight materials has made the satisfaction of these competing desires more easily accomplished. Tent fabrics, as well as tent poles and frame structures, can now be made to be very strong, while also very lightweight. This use of materials allows more imaginative and varied structures to be designed, which are still light enough to be easily portable, and thus practical for camping trips.

Another pair of competing needs facing campers and users of tents is that of the need for a reasonably small floor space, while providing enough internal volume for comfort. When camping in the woods, the extent of usable flat ground area may be limited, by trees or uneven terrain, thus a tent which has a large "footprint" or floor area will find fewer useable sites than one that has a smaller footprint. At the same time, a user will generally feel a need for "elbow room" and may feel cramped without a reasonable amount of space.

Thus there is a need for a tent which has a compact footprint, but which has an interior volume which is greater than that of a tent having the traditional inwardly tapering, or even strictly vertical walls.

SUMMARY

Accordingly, it is an object of the present invention to provide a tent which has a compact footprint.

Another object of the invention is to provide a tent which has an enlarged internal enclosed volume.

And another object of the invention is to provide windows which are protected from rain entry.

A further object of the present invention is to provide windows which are extended from the main body of the tent, and thus enlarge the interior volume.

Briefly, one preferred embodiment of the present invention is a tent with extendable windows having a main structure including a plurality of walls which are oriented at a first angle with respect to a vertical reference. The tent also includes at least one window which is extendable to a second angle with respect to a vertical reference, where the second angle is a more negative angle than the first angle thus producing windows which are extendable horizontally further than the tent walls.

An advantage of the present invention is that it provides extendable windows which extend from the main volume of the tent, and thus enlarge it.

Another advantage of the present invention is that the extendable windows can be retracted against the tent sides if necessary.

And another advantage of the present invention is that the extendable windows have a water-proof awning portion, and the screen area of each window slopes negatively back towards the main tent structure, thus preventing rain from entering.

A further advantage of the present invention is that the extendable windows provide an enlarged volume area at or around a typical adults' head, shoulder and torso area, thus providing enlarged volume in the area where more adults are largest, rather than down by their feet.

A yet further advantage is that the enlarged volume provides a psychological feeling of being less cramped to some people, which may be out of proportion to the actual increase in volume achieved.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

DETAILED DESCRIPTION

Figure 1:
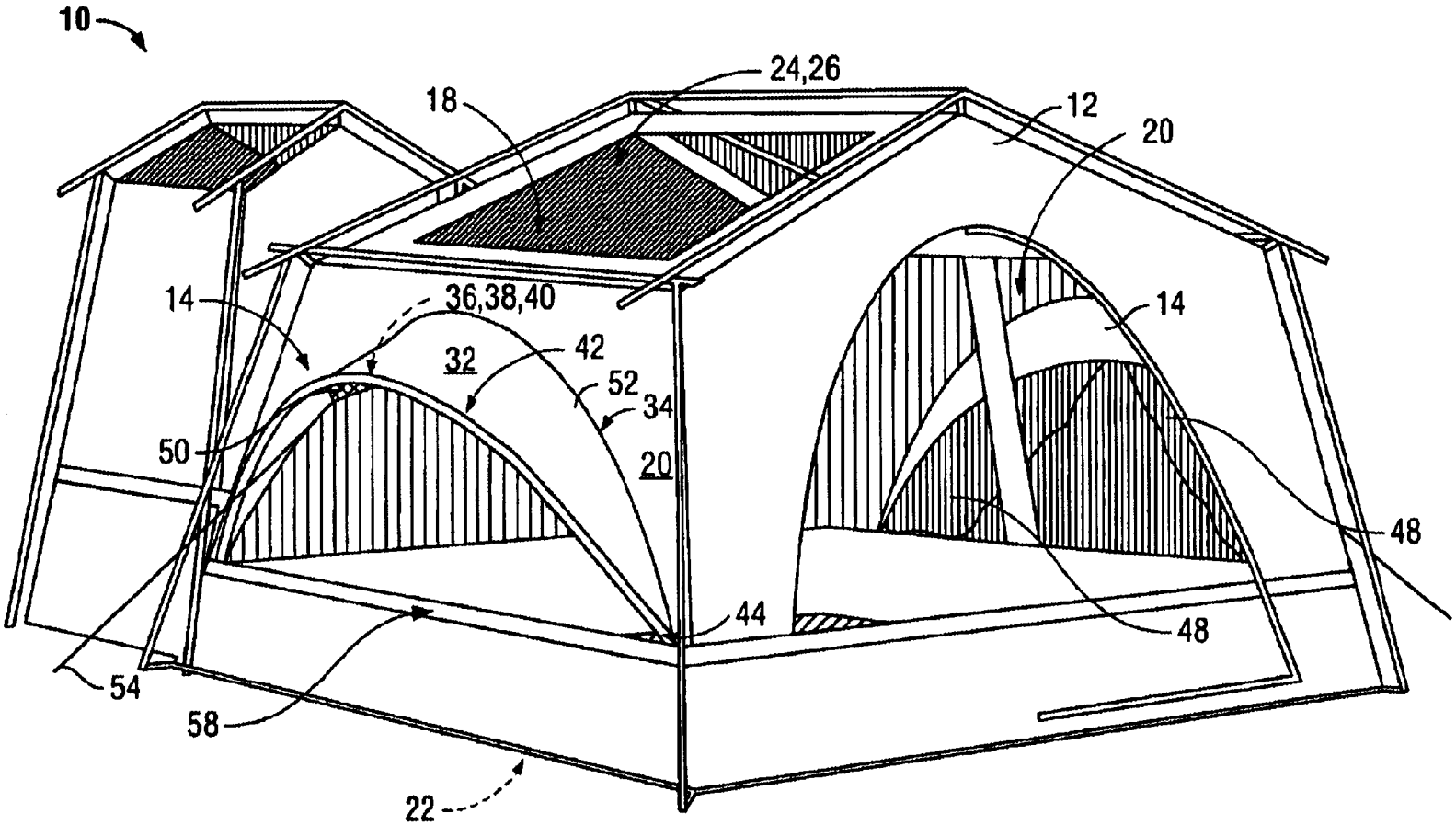
FIG. 1 shows an isometric front view of a tent with extendable windows having an open screen roof.

A preferred embodiment of the present invention is a tent with extendable windows. As illustrated in the various drawings herein, and particularly in the view of FIG. 1, a form of this preferred embodiment of the inventive device is depicted by the general reference character 10.

FIG. 1 illustrates an isometric view of a tent with extendable windows 10. The configuration of the actual tent main structure 12 may have many different forms and variations for which the extendable windows 14 of the present invention are suitable. The tent will generally include a front wall 16, a rear wall 18, side walls 20, a floor 22 and a roof or ceiling 24. In this figure, the roof 24 is open except for a screen 26, whereas in FIG. 4, below, the roof is a soffited roof 28 with an overhanging portion 30.

Figure 3:
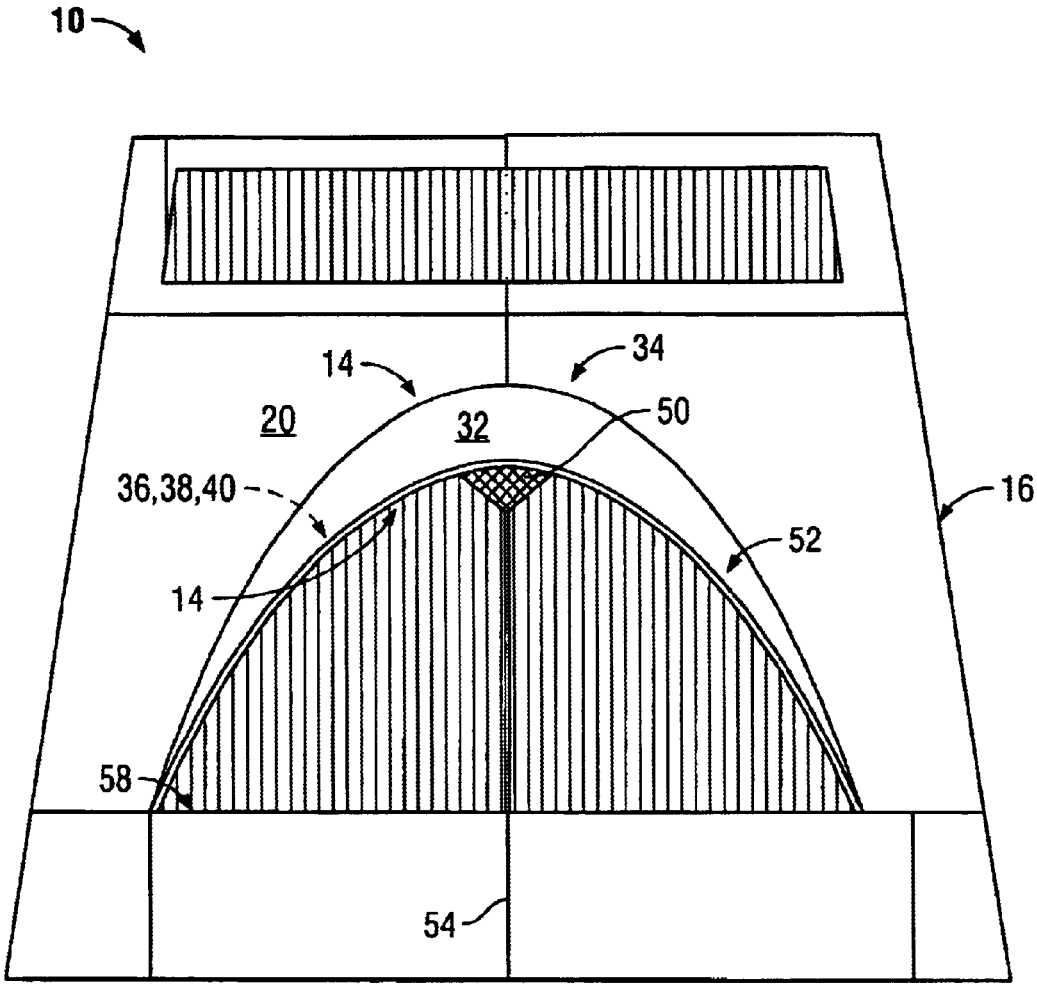
FIG. 3 shows a side plan view of a tent with extendable windows.

In FIGS. 1 and 3, there are shown to be two extendable windows 14, which are on either side wall 20 of the tent 10. This is of course one variation among many, as the rear wall 18 may, in other designs, include a extendable window, for a total of three, or there may be only one extendable window 14, or there may multiple smaller extendable windows along one side wall 20, in tents which have longer side walls 20 compared to the width of the front wall 16 shown here.

Figure 2:
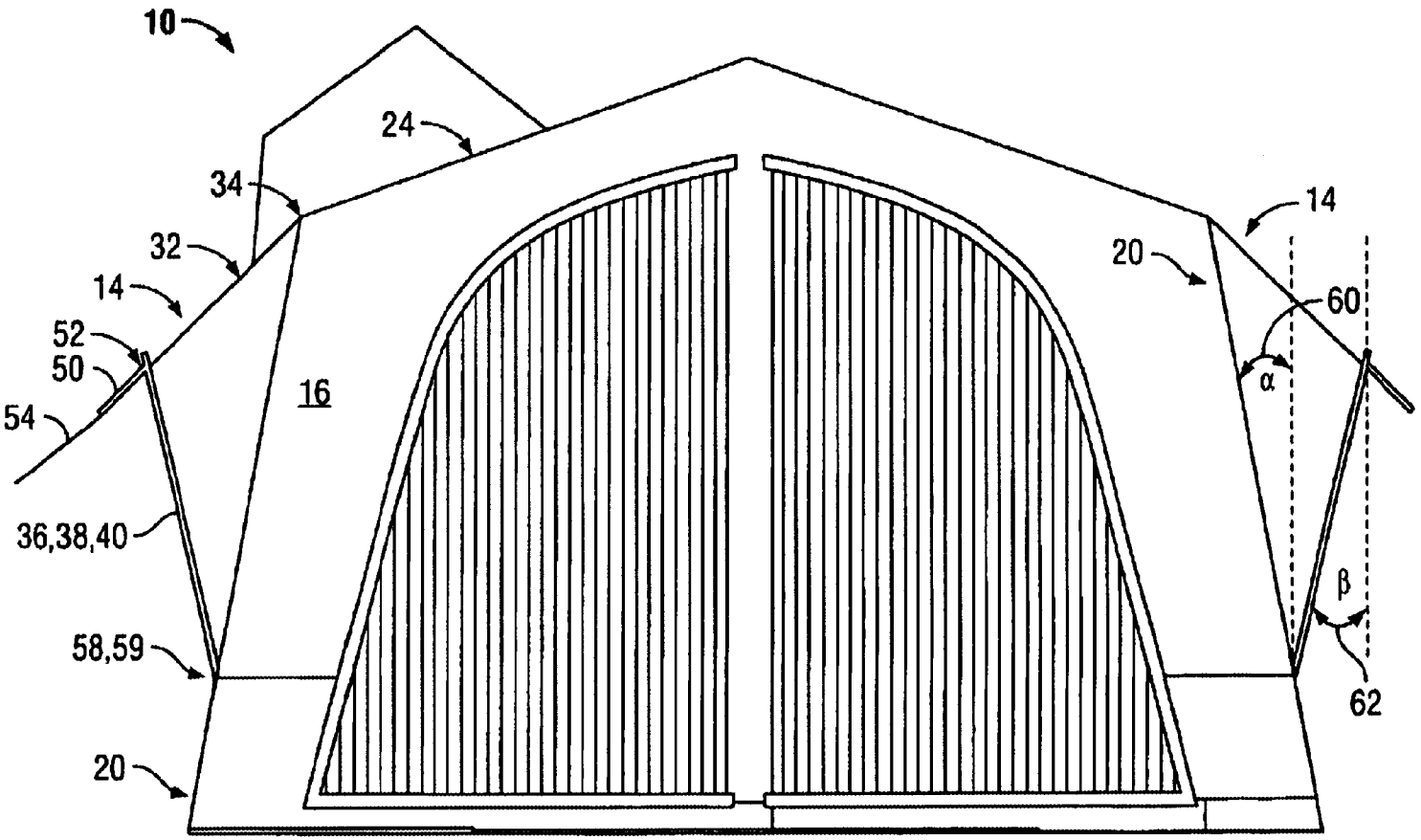
FIG. 2 illustrates a front plan view of a tent with extendable windows.
Figure 4:
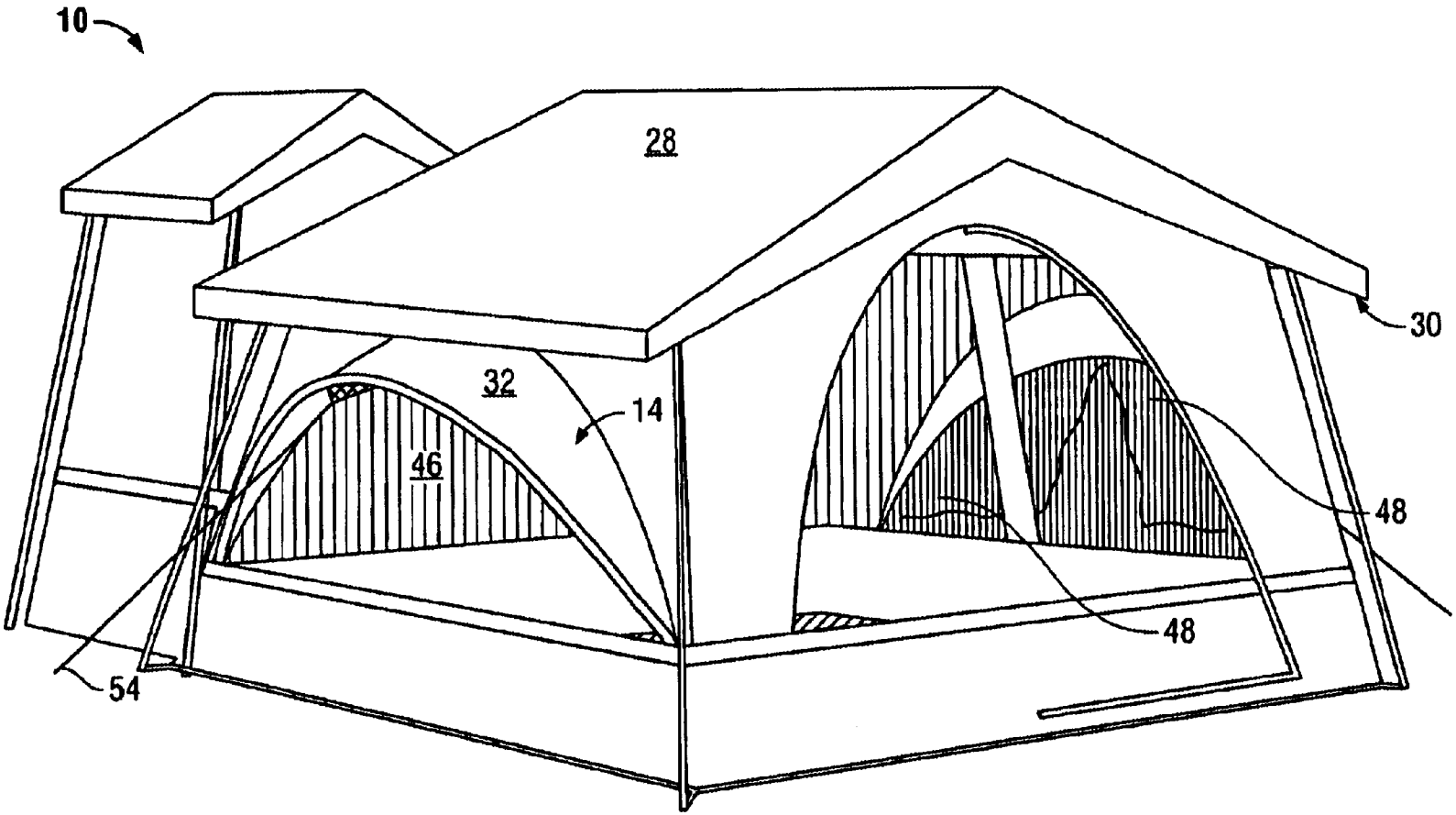
FIG. 4 illustrates an isometric view of a tent with extendable windows having a soffited roof.

Referring now also to FIGS. 2–4, the extendable window 14 includes an upper panel or awning 32, which is preferably water-proof or water resistant, and joined at a rear seam 34 to the main body of the tent 12. The extendable window 14 also preferably includes a frame 36, which in turn is preferably made up of several segments 38 which link together to form a bow-shaped member, roughly parabolic in shape, although this shape is not a requirement. The segments 38 may be completely detachable from each other, or they may be joined by an internal elastic cord 40 (not visible), which keeps the segments 38 together in proper order, but still allows the frame 36 to be folded for easy storage.

As seen especially in FIGS. 1 and 2, the extendable window 14 includes a cloth or fabric sleeve 42 into which the frame 36 fits. There are preferably openings 44 in the sleeve 42 through which the end of the frame 36 may be inserted. These opening 44 may be at various locations in the sleeve 42 and are not limited to the location shown.

The extendable window 14 also includes a screen portion 46, which is used to keep out insects, etc., and may include window flaps 48 or curtains, (not visible), which can be zipped together to keep out wind, light and to ensure privacy. These window flaps 48 may be internal or external to the tent main body 12, but are preferred to be internal.

The extendable window 14 also includes a screen portion 46, which is used to keep out insects, etc., and may include window flaps 48 or curtains, which can be zipped together to keep out wind, light and to ensure privacy. These window flaps 48 may be internal or external to the tent main body 12, but are preferred to be internal.

The extendable window 14 also includes a bat wing panel 50 located at or near the leading edge 52 of the extendable window 14. This bat wing panel 50 acts as an attachment site for a guy rope or wire 54. The guy wire 54 is attached to a stake 56 (not shown) or branch or other anchoring object, and serves to keep the extendable window 14 expanded to its full extent. The extendable window 14 has a hinge portion 59, in a manner of speaking, at its lower attachment seam 58, as the fabric to which the sleeve 42 ends are fastened, allow the frame 36 to pivot forward when the extendable window 14 is extended, as when tensioned by the guy wire 54. The extendable window 14 is however retractable to some extent, as for instance, when the camp site space is limited, and the extendable windows 14 would otherwise project into bushes or tree branches. In these cases, the frames 36 may be pivoted back towards the side walls 20 and perhaps fastened in place by VELCRO® loops, etc.

The side walls 20 shown in the figures slope inward in a conventional manner so that the floor area 22 is larger than the ceiling area 24. Thus a window which is co-planar with the walls 20 (which are generally at some positive angle $\alpha$ 60 with respect to a vertical line), would be expected to receive some run-off during rain storms, or some amount of the rain falling vertically in that area. However, the tent with extendable windows 10 has the advantage that the extendable windows 14 extend out past vertical to present a negatively sloped angle $\beta$ 62 to the screen 46, as can be seen in FIG. 2. The water-proof or water resistant awning 32 protects the window 14 from rain intrusion which falls vertically, and even prevents some component of wind-blown rain traveling at less than the negative angle $\beta$ 62. The window may also be at a positive angle $\beta$ 62, which is less positive (and thus more negative) than angle $\alpha$ 60 of the walls 20. Thus, when the angle of the windows is spoken of as more negative than the slope of the walls, it includes cases where the angle $\beta$ is negative, where angle $\beta$ is positive but less positive than the angle $\alpha$, or when the angle $\beta$ is vertical and angle $\alpha$ is positive. For purposes of this discussion, a positive angle is considered to extend in a counter-clockwise direction from a vertical reference, and a negative angle is assumed to extend in a clockwise direction.

The frame 36 gives a defined shape to the extendable window 14, but it is also possible to have a variation without a rigid frame, or perhaps no frame at all if additional guy wires or ropes are attached to the leading edge 52.

An advantage of the present invention 10 is that it provides additional space near the region of the average adult's head and shoulders, a space which is typically constricted by the inward sloping of the walls. Most humans are wider near the shoulder area or torso area, rather than at foot or knee-height. Additionally, most humans form their perception of being "cramped" or "crowded" from visual cues received from head height. By adding volume near the shoulder and head area, without effecting the floor area, the tent may be perceived as being much more comfortable and roomy, while still maintaining a compact "footprint" or floor area. The compact footprint will generally enable the user a larger selection of usable camp sites than one with a larger footprint.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

The present tent with extendable windows 10 is well suited for application in the home, backyard, or on camping trips and picnics.

The tent will generally include a front wall 16, a rear wall 18, side walls 20, a floor 22 and a roof or ceiling 24. One or more extendable windows 14 are included on either side wall 20 of the tent 10. The extendable windows 14 each include an upper panel or awning 32, which is preferably water-proof or water resistant, and joined at a rear seam 34 to the main body of the tent 12. The extendable window 14 also preferably includes a frame 36, which in turn is preferably made up of several segments 38 which link together to form a bow-shaped member, preferably roughly parabolic in shape. The segments 38 may be completely detachable from each other, or they may be joined by an internal elastic cord 40, which keeps the segments 38 together in proper order, but still allows the frame 36 to be folded for easy storage.

The side walls 20 generally slope inward in a conventional manner so that the floor area 22 is larger than the ceiling area 24. The extendable windows 14 preferably extend out past vertical to present a negatively sloped angle $\beta$ 62 to the screen 46. The water-proof or water resistant awning 32 protects the window 14 from rain intrusion which falls vertically, and even prevents some component of wind-blown rain traveling at less than the negative angle $\beta$ 62. The window may also be at a positive angle $\beta$ 62, which is less positive (and thus more negative) than angle $\alpha$ 60 of the walls 20. The frame 36 gives a defined shape to the extendable window 14, but it is also possible to have a variation without a rigid frame, or perhaps no frame at all if additional guy wires or ropes are attached to the leading edge 52.

The present invention 10 provides additional space near the region of the average adult's head and shoulders, a space which is typically constricted by the inward sloping of the walls. Most humans are wider near the shoulder area or torso area, rather than at foot or knee-height. Additionally, most humans form their perception of being "cramped" or "crowded" from visual cues received from head height. By adding volume near the shoulder and head area, without effecting the floor area, the tent may be perceived as being much more comfortable and roomy, while still maintaining a compact "footprint" or floor area. The compact footprint will generally enable the user a larger selection of usable camp sites than one with a larger footprint. Thus, the tent 10 is useful in many camping situations and is expected to be popular with users.

For the above, and other, reasons, it is expected that the collapsible chair with resilient support elements 10 of the present invention will have widespread industrial applicability. Therefore, it is expected that the commercial utility of the present invention will be extensive and long lasting.

THIS CORRESPONDENCE CHART IS FOR EASE OF UNDERSTANDING AND INFORMATIONAL PURPOSES ONLY, AND DOES NOT FORM A PART OF THE FORMAL PATENT APPLICATION.

10 tent with extendable windows
12 tent main structure
14 extendable windows
16 front wall
18 rear wall
20 side wall
22 floor
24 ceiling
26 screen roof
28 soffited roof
30 overhanging portion
32 awning
34 rear seam
36 frame
38 segments
40 internal elastic cords
42 sleeve
44 sleeve opening
46 screen
48 window flaps
50 bat wing panel
52 leading edge
54 guy wire
56 stake
58 lower attachment seam
59 hinge portion
60 angle $\alpha$
62 angles $\beta$

What is claimed is:

1. A tent with at least one extendable window designed to increase usable space in the tent comprising:

a main structure including a plurality of walls oriented at a first angle with respect to a vertical reference; and at least one window including a frame and screen extendable to a second angle with respect to a vertical reference, where the second angel is less than the first angle and the extended window is substantially vertical;

whereby the tent has increased usable space when the window is extended;

wherein the frame includes a flexible pole; and wherein the frame includes a sleeve into which the pole is positioned.

2. The tent of claim 1, wherein:

a lower attachment scam at a location below the midline of the main structure where a lower edge of the window attaches to the wall of the tent, which acts as a hinge mechanism, allowing the window to extend or retract.

3. The tent of claim 1, wherein:

the window includes a flap configured to selectively cover the window.

4. A tent with at least one extendable window designed to increase usable space in the tent comprising:

a main structure including a plurality of walls oriented at a first angle with respect to a vertical reference; and at least one window including a frame and screen extendable to a second angle with respect to a vertical reference, where the second angle is less than the first angle and the extended window is substantially vertical;

whereby the tent has increased usable space when the window is extended;

wherein the window includes an awning coupled to the main structure and the frame, and configured to hold the window in an extended orientation;

wherein the frame includes a flexible pole; and wherein the frame includes a sleeve into which the pole is positioned.

5. The tent of claim 4, wherein:

the awning is configured to hold the window frame in a substantially vertical orientation.

6. The tent of claim 5, wherein:

a lower attachment seam at a location below the midline of the main structure where a lower edge of the window attaches to the wall of the tent, which acts as a hinge mechanism, allowing the window to extend or retract.

7. The tent of claim 5, wherein:

the window includes a flap configured to selectively cover the window.

8. The tent of claim 4, wherein:

a lower attachment seam at a location below the midline of the main structure where a lower edge of the window attaches to the wall of the tent, which acts as a hinge mechanism, allowing the window to extend or retract.

9. The tent of claim 4, wherein:

the window includes a flap configured to selectively cover the window.

10. A tent with extendable windows designed to increase usable space in the tent comprising:

a main structure including a plurality of walls oriented at a first angle with respect to a vertical reference; and a plurality of windows each including an awning, frame and single screen extendable to a substantially vertical orientation;

whereby the tent has increased usable space when the windows are extended;

wherein the frame includes a flexible pole; and wherein the frame includes a sleeve into which the pole is positioned.

* * * * *